United States Patent [19]

Collas et al.

[11] Patent Number: 4,928,362

[45] Date of Patent: May 29, 1990

[54] BUTTON, PARTICULARLY FOR ARTICLES OF CLOTHING

[75] Inventors: Wolfgang Collas; Günter Wolfertz; Roger Wolfertz, all of Wuppertal, Fed. Rep. of Germany

[73] Assignee: Schaeffer GmbH, Wuppertal, Fed. Rep. of Germany

[21] Appl. No.: 260,801

[22] Filed: Oct. 20, 1988

[30] Foreign Application Priority Data

Oct. 24, 1987 [DE] Fed. Rep. of Germany ... 8714192[U]

[51] Int. Cl.[5] ..... A44B 18/00; A44B 42/00

[52] U.S. Cl. ..... 24/90 R; 24/94

[58] Field of Search ..... 24/90 R, 92, 93, 94, 24/95, 108, 113 R

[56] References Cited

U.S. PATENT DOCUMENTS

| | | | |
|---|---|---|---|
| 346,112 | 7/1886 | Kyle | 24/95 |
| 1,292,914 | 1/1919 | Stone | 24/90 R |
| 1,497,339 | 6/1924 | McCann | 24/95 |
| 1,780,555 | 11/1930 | Johnson . | |
| 1,943,063 | 1/1934 | Fenton | 24/95 |
| 2,247,522 | 7/1941 | Purinton | 24/90 R |
| 4,512,063 | 4/1985 | Fukuroi | 24/94 |
| 4,607,415 | 8/1986 | Fukuroi | 24/94 |
| 4,782,558 | 11/1988 | Sparrow | 24/90 R |
| 4,788,753 | 12/1988 | Sparrow et al. | 24/92 |

FOREIGN PATENT DOCUMENTS

| | | |
|---|---|---|
| 0090131 | 1/1983 | European Pat. Off. . |
| 3405830 | 10/1984 | Fed. Rep. of Germany . |
| 1418248 | 10/1965 | France . |

*Primary Examiner*—Victor N. Sakran
*Attorney, Agent, or Firm*—Martin A. Farber

[57] ABSTRACT

A button having a button shank adapted to be fastened to an article of clothing and a section forming a single piece with it which connects via a flexible bridge of material to a button plate. A bridge of material (B) which bears the section (A) and receives the buttoning forces concentrically surrounds the button shank, and the section (A) is developed as a surrounding button edge bead.

8 Claims, 2 Drawing Sheets

BUTTON, PARTICULARLY FOR ARTICLES OF CLOTHING

FIELD AND THE BACKGROUND OF THE INVENTION

The present invention relates to a button, particularly for articles of clothing, having a button shank adapted to be fastened to the article of clothing, and having a section integrally formed with the shank which connects, via a flexible bridge of material, to a button plate.

A button of this type is known from Federal Republic of Germany OS No. 3,405,830. The button plate thereof is tiltable relative to the shank. Furthermore, this type of development permits a certain axial displacement. The flexible bridge of material always restores the button to its basic position; to this extent it acts as a return spring. A metal covering of the body of the button, which is interrupted in the region of the shank, defines this basic position, which cannot be exceeded in axial direction.

Such a button requires a relatively large number of parts. In particular, the fact that the bridge of material is located close to the axis facilitates the shearing off of the button plate when turning is effected thereon, a variant of the urge to play which can be again and again observed.

SUMMARY OF THE INVENTION

The object of the invention is to create a button of this type which, while having only a few structural parts, is of great stability in use while nevertheless having more favorable buttonability.

According to the invention a button having a button shank adapted to be fastened to an article of clothing and a section forming a single piece with it connects via a flexible bridge of material to button plate, the invention being characterized by the fact that a bridge of material (B) which bears a sections (A) and receives the buttoning forces concentrically surrounds the button shank (2), and wherein the section (A) is developed as a surrounding button edge bead (11).

As a result of this development, there is obtained a button of this type which is of increased value in use.

It is characterized, in particular, by improved buttonability, which is due essentially to the axial lengthening of the button shank obtained. Such a button-plate attachment thus exceeds in flexibility even the conventional sewn stem. Particularly for children's clothing and that of older people, the solution found even has a considerable advantage. Specifically, one proceeds in the manner that the bridge of material, which bears the section and takes up the buttoning forces, concentrically surrounds the button shank and that said section is developed as a surrounding button edge bead. The attachment of the section forming the button plate lies so far from the axis that it makes said shearing-off difficult. Furthermore due to the surrounding button edge bead there is obtained a high extent of trueness of shape with respect to the section forming the actual button plate, thus even making it unnecessary to provide also a special applique unless this is desired for reasons of fashion. In this respect the solution of the invention also affords optimal prerequisites as a result of the stiffening action of the bead zone.

The bridge of material in advantageous manner attaches to the outside-wall region of the button shank and is therefore radially oriented. In this connection it is found favorable for the bridge of material to be developed in spoke form. This not only increases the flexibility but also serves to save material. In this case it is then advantageous that the spokes extend from the button shank in axial direction of the latter towards the button plate and are transformed into a radially directed arch, finally then entering into the inside of the button edge bead. Such an arch forms a considerable reserve for lengthening and movement for the tilting movement of the button plate and the axial displacement which is superimposed thereon or can be carried out independently thereof. In this connection, such an arcuate shape can be selected that a sort of over-snap effect is formed which defines a first position of the button plate which is close to the support material and a further-protruding position so that, after the buttoning, the button is brought into greater closeness to the support material simply by axially directed force.

Furthermore it is found advantageous for a central dome of the button shank to extend from the root region of the bridge of material. This dome results in the saving of material and does not permit rain water, for instance, to enter into the region of attachment. It is furthermore advantageous that an axially directed central fastening cavity for a fastening mandrel extend up into the dome. This creates, over the entire length, a coherent, material-saving recessing of the button shank, with correspondingly great elasticity of the remaining annular wall.

One advantageous variant of the development of the bridge consists therein that the bridge of material is developed is a radially directed folded bellows. In this case, there is advisedly considered a concentrically, amply undulated wall section, which, for space-saving reasons, extends advisedly in a plane transverse to the axis of the button shank. Finally, it is favorable for the button shank, bridge of material and button edge bead to consist of plastic. Recourse is then had to material which is capable of coming back into position, and therefore has the required flexibility.

BRIEF DESCRIPTION OF THE DRAWINGS

With the above and other objects and advantages in view, the present invention will become more clearly understood in connection with the detailed description of a preferred embodiment, when considered with the accompanying drawings, of which.

DETAILED DESCRIPTION OF THE PREFERRED EMBODIMENT

Figure 1:
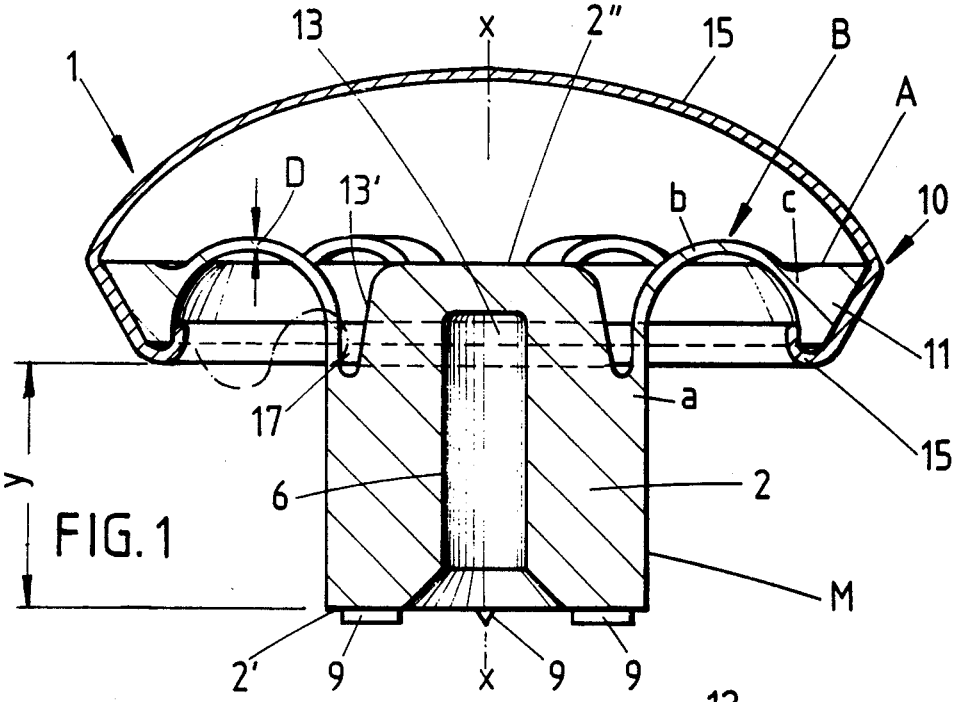
FIG. 1 is a vertical section through a button developed in accordance with the invention.
Figure 2:
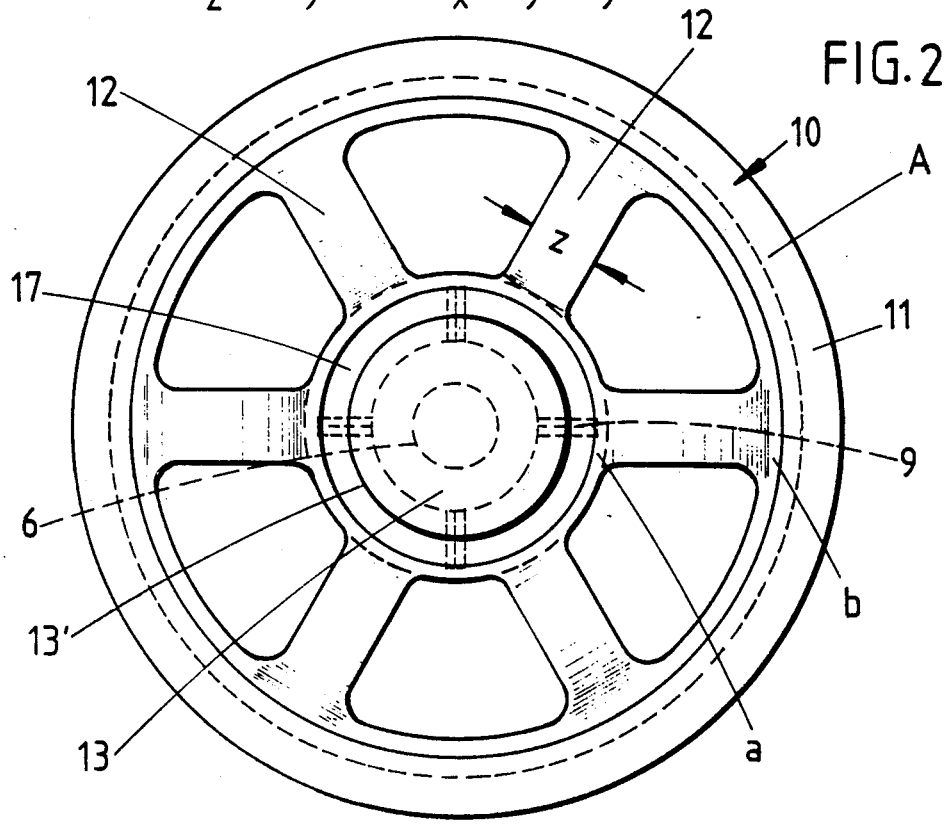
FIG. 2 is a top view thereof with an applique omitted.

The button 1, which can be used in particular for articles of clothing, has a substantially cylindrical button shank 2, comparable to the conventional button shank obtainable by thread loops.

The button 1 is fastened on a support 3. Here there is considered for instance, so-called "button strip" of an article of clothing, which strip is covered by a cover strip bearing suitable button holes.

As button fastening means there is used a holding mandrel 4, which can here be driven-in from the rear of the support 3. The mandrel is pointed to provide a fabric-protecting passage through the fabric. The region 5 of the mandrel tip forms a conical thickening, which, in practice, results in an irreversible anchoring within the shank 2. The button shank 2 has a cylindrical fastening cavity 6 for receiving the holding mandrel 4. The attachment cavity 6 extends in the center of the button shank 2 and therefore in a longitudinal center axis x13 x of the button 1.

The section of the holding mandrel 4, which faces away from the region of the tip 5 passes via a frustoconical section 7 into a holder-up plate 8. The latter is of cap shape and has a diameter which is greater than that of the button shank 2.

The entrance to the attachment cavity 6 is funneled in accordance with the shape of the frustoconical section 7.

In order to secure the button 1 against turning, radial ribs 9 are formed on the front end 2' of the button shank 2 which faces the holder-up plate 8. The radial ribs are shaped with a cutting-edge and therefore are triangular in cross section, one side of the triangle being rooted in the flat, annular front end 2'. As can be noted from FIG. 3, the radial ribs 9 in the connecting region to the holder-up plate 8 engage into the section of the support 3 which is compressed there.

As a whole, four axial ribs 9 arranged at equal angles apart are produced. The peripheral region of the front end is set back from the wall region M of the cylindrical button shank 2, so that the radial ribs 9 are invisible.

The button shank 2 extends on the side facing away from the support 3 into a button plate 10. The latter extends in its basic position parallel in space to the holder-up plate 8, in a shank-corresponding basic distance y from the support 3.

The connection of the button plate 10 is effected by a flexible bridge of material B, which acts on a section A belonging to the button plate 10.

The bridge of material B, which bears the section A and receives the buttoning forces, concentrically surrounds the button shank 2. The section A is developed as a surrounding button edge bead 11. Button shank 2, bridge of material B and button edge bead 11 are made in a single piece of plastic i.e. injection molded. The button-shank-side connection of the flexible bridge of material B lies in the region of the outer wall M of the button shank 2, namely both in the embodiment according to FIG. 1 and in the variant according to FIG. 3, in the upper fourth or third of the button shank facing away from the support. In each case a connection in the manner of a film hinge is considered.

The flexible bridge of material B in accordance with FIG. 1 is of spoke-shaped development. The spokes bear the reference numbers 12. As in the case of a wheel body, these spokes 12 are arranged at an equal angle apart. As a whole, there are taken into account six spokes 12. Their width z corresponds approximately to five times the thickness D thereof. To this extent it is possible to speak in connection with the spokes of practically strip-shaped sections of material.

The spokes 12 extend from the outer-wall-region-side starting point a, first in the axial direction of the button shank 2 towards the button plate 10 and then into a definite, radially outwardly-directed arch b. The arch b assumes a circular course and extends over about 180°. Finally, the arch b extends into the inside of the button edge bead 11. The corresponding point of introduction is marked "c". The radius point of the arch b lies approximately in the central plane of the height of the button edge bead 11. The zenith of the arch b extends above the top side of the section A. The corresponding protrusion is relatively slight.

The top side of the section A is aligned in the basic position in the same plane as the inverse end surface 2'' of the button shank 2. This also is true with respect to the variant shown in FIG. 3.

The button-shank-side root region (starting point a) of the bridge of material b extends from the central dome 13 of the button shank 2. The latter is adjoined on the support side by the above-mentioned attachment cavity 6. The flat cupula of the dome 13 closes the attachment cavity 6 off from the outside, i.e. towards the top.

Figure 3:
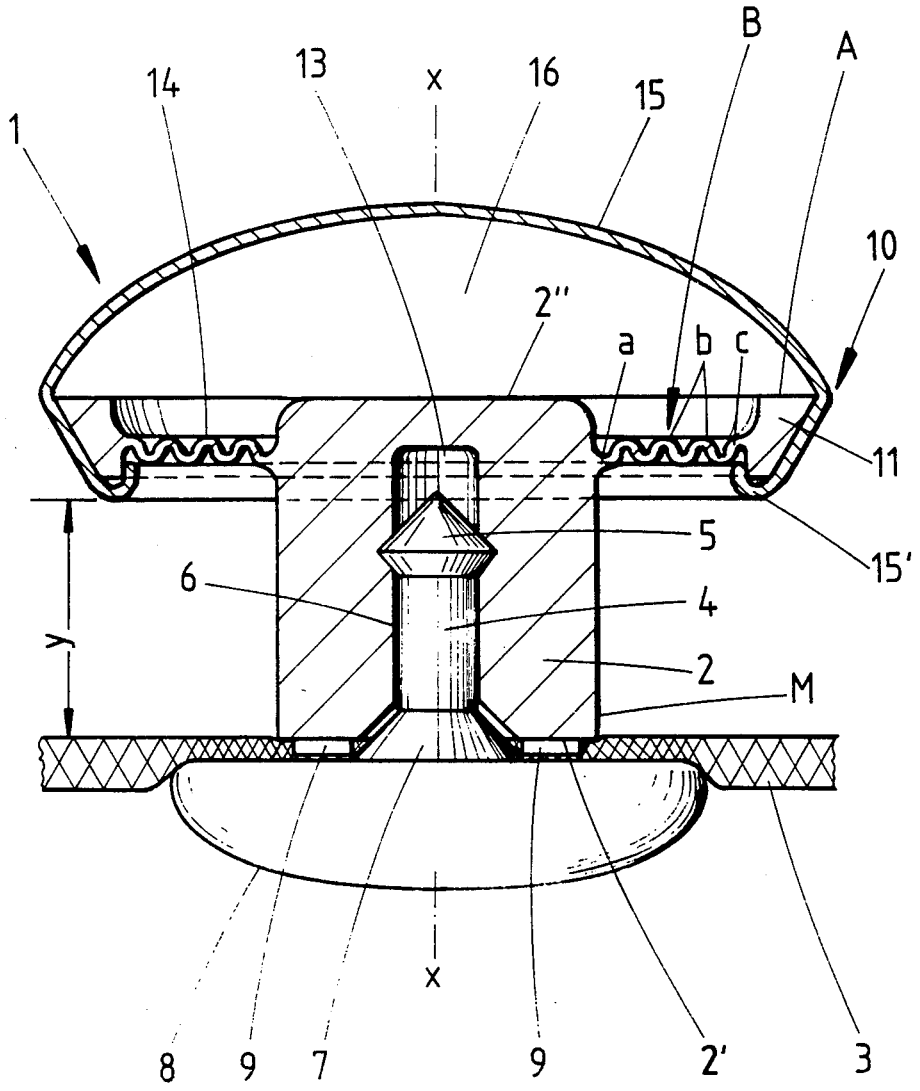
FIG. 3 is a vertical section through a variant of the button of the invention, completely mounted and therefore with holer-up part driven into the button shank.

The bridge of material b in accordance with FIG. 3 consists of a folded bellows 14 consisting of a large number of small arches b which are coherent, however, in circumferential direction. The bellows extends in the same plane over the shortest path to the inside of the button edge bead 11. As can be seen, relatively close undulation is selected. The latter creates, like the above-mentioned arches B, a lengthening reserve for the shank 2 and the button plate 10. The latter is, as a result, not only optimally tiltable but is also displaceable in axial direction, exceeding the basic distance y. Regardless of this, upon the action of pressure on the button plate, displacements in the direction of the support material are also possible, without any danger of damage in view of the reserve stretch of the bridge of material b.

With reference to FIG. 1, even a sort of plot effect can be obtained.

The button plate 10 can optionally be spanned by a cap-shaped appliqué 15. The latter engages behind the button edge bead 11, which has an undercut surface. The inwardly arched inner edge thereof is turned in from the bottom. This edging bears the reference number 15'. The fastening hold which is sufficient for use is obtained by the appliqué 15 by direct edge engagement over the upper outer edge of the button edge bead 11. The arching of the appliqué is such that a considerable free space 16 for relative axial movement of the self-supporting button plate 10 with respect to button shank 3 is made possible.

The dome 13 in accordance with the first embodiment is set back with respect to the maximum diameter of the button shank 2, so that a notched, valley-like annular zone 17 is present which is of importance, on the one hand, for reasons of removal from the mold, but also, on the other hand, favors support-side movements of displacement of the button plate 10 parallel to its basic position; ther is a radially inward-directed evasion zone, although a small one, until application against the conventional dome outer flank 13'. Furthermore, the snap-on effect is favored (see dot-dash S-shape in FIG. 1). Even horizontal transverse displacement is possible as a result of this. The corresponding transverse displacement can also take place in the variant in accordance with FIG. 3, for which purpose the bellows folds place themselves on the one side at a flatter flank angle and on the other side in a steep, up to vertical, alignment of the bellows-fold flanks.

We claim:

1. A button comprising a button shank adapted to be fastened to an article of clothing; and a button plate integrally formed with said shank; and wherein said button plate comprises an edge bead concentric to an axis of the shank, and a bridge of flexible material connecting the bead to the shank; and wherein said bridge receives buttoning forces and concentrically surrounds the button shank; and said bridge is sufficiently flexible to permit displacement of said bead along an axis of said shank.

2. A button according to claim 1, wherein said shank has a cylindrical form with an outer wall region; and said bridge is connected to said wall region.

3. A button according to claim 1, wherein said bridge comprises a plurality of spokes.

4. A button according to claim 3, wherein each of the said spokes extends in axial direction of said button shank and from said shank towards said button plate via a radially directed arch which terminates at the inside of the button edge bead.

5. A button according to claim 1, wherein said shank has a central dome extending from a region of a root of said bridge.

6. A button according to claim 5, wherein said shank has an axially directed central fastening cavity for a holding mandrel, said cavity extending up into said dome.

7. A button according to claim 1, wherein said bridge is formed as a radially directed folded bellows.

8. A button according to claim 1, wherein said shank and said bridge and said button edge bead are formed of plastic.

* * * * *